US005378324A

United States Patent [19]

Hodgson

[11] Patent Number: 5,378,324

[45] Date of Patent: Jan. 3, 1995

[54] PROCESS AND AN ELECTROLYTIC CELL FOR THE PRODUCTION OF FLUORINE

[75] Inventor: Graham Hodgson, Lancashire, England

[73] Assignee: British Nuclear Fuels Plc, Cheshire, United Kingdom

[21] Appl. No.: 42,263

[22] Filed: Apr. 2, 1993

[30] Foreign Application Priority Data

Apr. 4, 1992 [GB] United Kingdom ..... 9207424

[51] Int. Cl.[6] ..... C25B 1/24; C25B 11/00

[52] U.S. Cl. ..... 204/60; 204/245; 204/247; 204/237; 204/234

[58] Field of Search ..... 204/60, 128, 275, 237, 204/234, 245, 241

[56] References Cited

U.S. PATENT DOCUMENTS 4,125,443 11/1978 Gant ..... 204/60

4,950,370 8/1990 Tarancon ..... 204/128

FOREIGN PATENT DOCUMENTS 0150285 8/1985 European Pat. Off. .

7731270 10/1977 France .

*Primary Examiner*—Kathryn Gorgos

*Attorney, Agent, or Firm*—Nixon & Vanderhye

[57] ABSTRACT

A process and an electrolytic cell for the production of fluorine. A fluorine-containing electrolyte is passed in non-turbulent flow between an anode and a cathode of the electrolytic cell. The electrolyte emerging from between the anode and the cathode is divided into two streams. One stream emerges adjacent to the anode and has fluorine entrained therein, the other stream emerges adjacent to the cathode and has hydrogen entrained therein. The fluorine and the hydrogen are subsequently separated from their respective streams of electrolyte.

17 Claims, 5 Drawing Sheets

PROCESS AND AN ELECTROLYTIC CELL FOR THE PRODUCTION OF FLUORINE

BACKGROUND OF THE INVENTION

1. Field of the Invention

This invention relates to a process and to an electrolytic cell for the production of fluorine.

2. Discussion of Prior Art

The designs of presently used fluorine-producing electrolytic cells give rise to many problems. These problems include:

1. Poor Energy Efficiency

This is due to two main factors:

(a) a high anode overvoltage due to the formation of a resistive carbon fluoride polymer film at the anode surface, and (b) a high electrolyte ohmic loss, due to the necessity (in present designs) of allowing a large gap between anode and cathode to minimise the recombination of the product fluorine and hydrogen which would otherwise reduce the current efficiency.

2. Low Space/Time Yield

This can be defined as the mass of product per unit volume of electrolytic cell, per unit time. In present designs of cells, the space/time yield for fluorine is inherently low due to the poor ratio of unscreened anode area to cell volume. The thickness of the anodes (>30 mm), and the large anode and cathode gap mentioned above compound the problem. The end result is that an electrolytic plant for the production of modest quantities of fluorine occupies a vast area (compared with analogues such as chlorine).

3. Poor Reliability

Anode failures are well known to those "skilled in the art", such failures including: "polarization" (the development of an unusually high anode overvoltage), anode breakage, failure of the electrical connections, and burning in fluorine.

4. Low Pressure of Product Gases

It is an inherent feature of the fluorine-producing electrolytic cells presently used that for safe operation the fluorine off-gas pressure can be no greater than the hydrostatic head provided by the submerged gas separating skirts when the evolved hydrogen off-gas pressure is at atmospheric pressure. In practice, this effectively limits the evolved fluorine pressure to a maximum of approximately 10 cm water gauge. Operation above this pressure is theoretically possible if the hydrogen and fluorine pressures are kept in perfect balance, but a sudden failure of an external seal or joint could then result in a fluorine/hydrogen explosion within the electrolytic cell.

5. Maintenance and Corrosion Problems

There are also maintenance problems with present designs caused, to some extent, by the highly corrosive nature of fluorine, and the effect of "misting" in which an aerosol of the electrolyte becomes entrained in the fluorine gas and is deposited on the walls of pipework outside the cell, thus leading to restrictions and eventually to blockages in the pipework.

It is, therefore, an object of the present invention to provide a process and an electrolytic cell for the production of fluorine in which the above-mentioned problems are alleviated to some extent.

SUMMARY OF THE INVENTION

According to one aspect of the present invention, there is provided a process for the production of fluorine; the process comprises passing a fluorine-containing electrolyte in non-turbulent flow between an anode and a cathode of an electrolytic cell, and dividing the electrolyte emerging from between the anode and the cathode into two streams where one said stream emerges adjacent to the anode having fluorine entrained therein, and the other said stream emerges adjacent to the cathode having hydrogen entrained therein, and subsequently separating the fluorine and the hydrogen from the respective said streams.

According to another aspect of the present invention, an electrolytic cell for the production of fluorine comprises an anode and a cathode in relatively close juxtaposition, means for inducing an electrolyte to pass in non-turbulent flow between the anode and the cathode, and means for dividing the electrolyte emerging from between the anode and the cathode into two streams where one said stream emerges adjacent to the anode and the other said stream emerges adjacent to the cathode.

Preferably, the anode and the cathode have flat surfaces in parallel opposing relationship, and said flat surfaces desirably define a gap of 20 mm or less.

The inducing means may include a foraminuous element, or baffles, or a plurality of channels (e.g. a bundle of tubes), and/or parallel plates located at an entry to the space between the anode and the cathode.

Preferably, the non-turbulent flow is streamline flow, or laminar flow, and desirably the flow is at a Reynold's Number of less than 2000, e.g. 500.

Advantageously, the flow conditions are selected to constrain the fluorine and hydrogen produced to flow substantially adjacent to the anode and the cathode respectively.

The dividing means may comprise a knife-edged flow divider, and may be located mid-way between the anode and the cathode. Alternatively, the flow divider may be located in offset-relationship between the anode and the cathode, preferably off-set towards the anode to increase the volume of the stream containing the hydrogen.

The electrolytic cell of the invention may be incorporated in a system in which disengagement of the fluorine and hydrogen from their respective streams can be performed by means of separate vessels that may also serve to cool and filter the electrolyte. The two streams of gas-free electrolyte from the disengagement vessels may then be combined and recycled to the electrolytic cell inlet. The hydrogen fluoride in the electrolyte consumed during the electrolysis can be replaced by continuous addition to the streams at any stage after they have left the electrolytic cell.

The effect achieved by the invention is that most of the fluorine evolved at the anode slides up the surface of the anode. Although some of the fluorine will break away from the surface of the anode, the fluorine should remain in close proximity to the anode surface as it flows upwardly in the stream of the electrolyte. The hydrogen evolved at the surface of the cathode does break away from the cathode surface, but it should still remain close to the cathode surface as it rises upwardly in the stream of electrolyte. In this way, the product gases are inhibited from meeting and recombining despite the anode and cathode surfaces being in close juxtaposition. The single stream of electrolyte in the cell containing both hydrogen and fluorine is then split into two streams, one stream containing the greater part of the hydrogen and the other stream containing the greater part of the fluorine. It may be desirable in some cases to supplement this effect by the incorporation of a permeable mesh gas separator (e.g. 100 micron pore size) placed between the anode and the cathode for part or all of the length of the anode and the cathode.

It is to be noted that it is normal in electrochemical technology to promote turbulence in the inter-electrode gap in order to improve mass transfer. However, in the case of the fluorine evolution reaction, mass transfer is not the limiting effect at the current densities employed.

Some of the advantages from use of the invention are:

1. The reduced anode-cathode gap significantly reduces the electrolyte ohmic loss and thus improves the power efficiency without the penalty of increased fluorine/hydrogen recombination which would be the case if the gap were reduced in a present design of cell.

2. The compact nature of the design due to the narrow anode-cathode gap allows the anodic current density to be reduced considerably, possibly three-fold, without compromising space/time yield. The lower the operating current density of the cell, the lower are the overvoltages at both the anode and the cathode, and the lower are the ohmic losses throughout the cell. Hence, the power efficiency is further improved.

3. The narrow anode-cathode gap allows greatly increased fluorine output per unit volume if the anode current density is maintained at that used in present cell designs. However, it is desirable for energy efficiency and reliability to operate the cell at reduced current density, thus negating some of the space/time yield advantage. If the latter factor is of prime importance for a specific application (e.g. limited space available), the compact nature of the cell can be fully exploited but at the expense of a slightly reduced improvement in energy efficiency.

4. Many of the corrosion problems in present cells are associated with the necessarily high operating voltages employed (9–11 volts per cell), thus giving rise to severe electrochemical corrosion (e.g. bipolar corrosion of gas separating skirts in the current path). The reduced operating voltage possible per cell using the invention (e.g. 5.5 to 6.0 volts) significantly reduces the rate of electrochemical corrosion, particularly that of a bipolar nature. The reduced voltage also reduces the formation of carbon fluoride polymer on the anode surface, and hence, "polarization" failures of anodes are less likely. In present cells, the heat generated as a result of the high anode overpotential when operating at high cell voltages initiates burning and breakage of the anodes. Broken anodes can then cause short circuits between the anode connection and the cooling coil, and this often results in a holed coil and water leaking into the cell, which stops fluorine generation.

5. The design allows safe operation at pressures many times that possible in existing designs because it does not rely on a gas separating skirt system to keep the reservoirs of hydrogen and fluorine gas separate.

The invention will now be further described by way of example only with reference to the accompanying drawings in which:

DESCRIPTION OF THE PREFERRED EMBODIMENTS

Figure 1:
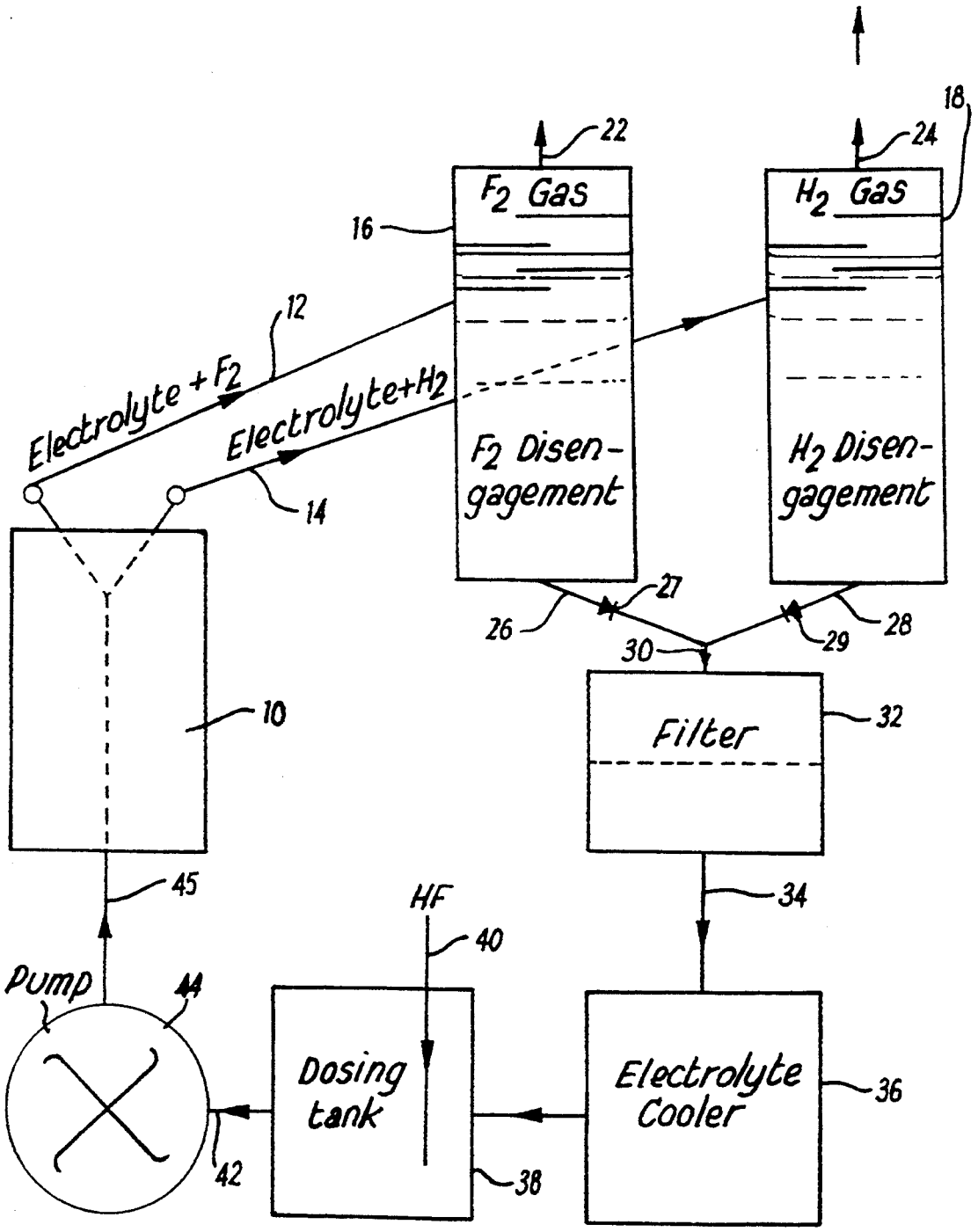
FIG. 1 shows a schematic representation of a fluorine production system.

Referring now to FIG. 1 the system shown comprises an electrolytic cell unit 10 having outlet ducts 12, 14 connected to a fluorine disengagement section 16 and a hydrogen disengagement section 18 respectively of conventional designs.

The sections 16, 18 have gas outlets 22, 24, and have bottom discharge ducts 26, 28 with non-return valves 27, 29 respectively, the ducts 26, 28 being joined to a common duct 30 leading to a filter unit 32. The filter unit 32 has a bottom discharge duct 34 connected to a cooler 36 which discharges to a dosing tank 38 having a feed inlet 40. The tank 38 has a discharge duct 42 connected to a pump 44 which is connected by a duct 45 to discharge to the cell unit 10.

Figure 2:
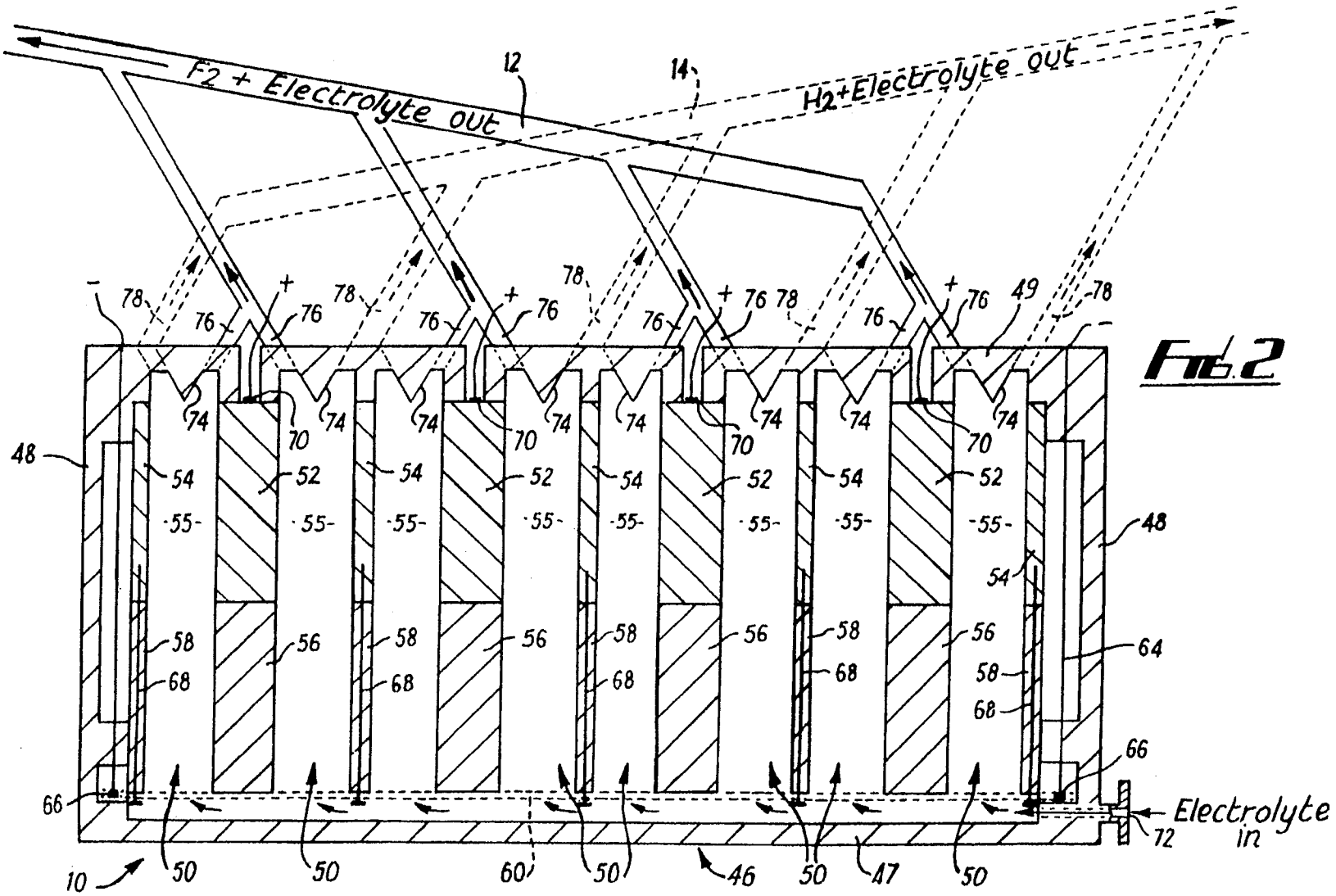
FIG. 2 shows a diagrammatic representation of an electrolytic cell in the system of FIG. 1 in sectional elevation.

Referring now to FIG. 2, the cell unit 10 shown comprises a vessel 46 which may be of fluoroplastic material (e.g. PTFE) or plastic polymer coated steel, and has a base 47, sides 48, and a roof 49. A bank of eight electrolytic cells 50 are disposed in parallel in the vessel 46, each cell 50 having a carbon anode 52 and a steel cathode 54 each of plate form and in parallel opposing relationship to define a relatively narrow space 55, adjacent cells 50 sharing a common anode 52 or cathode 54. The lower portion of each anode 52 and cathode 54 is joined to a fluoroplastic (e.g. PTFE) portion 56, 58 respectively of the same cross-sectional dimensions as the respective anode 52 or cathode 54. A foraminuous member in the form of a steel sieve plate 60 extends parallel to the base 47 at the bottom of the fluoroplastic portions 56, 58. Cathodic electrical connections 64 are made to the sieve plate 60 at locations 66 at each side 48 of the vessel 46, and electrical connections 68 extend between each cathode 54 and the sieve plate 60 through the fluoroplastic portions 58. Anodic electric connections are made to each anode 52 at 70. An entry port 72 for electrolyte from the duct 45 of FIG. 1 (not shown) is provided at one side 48 of the vessel 46 below the sieve plate 60. The roof 49 of the vessel 46 is shaped to form vee-shaped flow dividers 74 extending from mid-way between each anode 52 and cathode 54 so as to split electrolyte flowing upwardly between adjacent anodes 52 and cathodes 54 into two streams, each stream being diverted into a respective duct 76, 78 (shown in broken line) joined to the outlet ducts 12, 14 respectively of FIG. 1.

In operation with fused electrolyte containing potassium fluoride and hydrogen floride (KF.2HF) at about 100° C., the pump 44 circulates the electrolyte through the system of FIG. 1. Electrolyte enters the vessel 46 of FIG. 2 through the port 72 and passes through the sieve plate 60 into the spaces 55. The flow of the electrolyte is controlled so as to be non-turbulent, a Reynolds Number below 2000 being preferred, the sieve plate 60 and the fluoroplastic portions 56, 58 assisting in inducing this non-turbulent flow of the electrolyte. The known chemical reaction occurs in each cell 50, viz:

$$2HF \rightarrow F_2 + H_2$$

Figure 3:
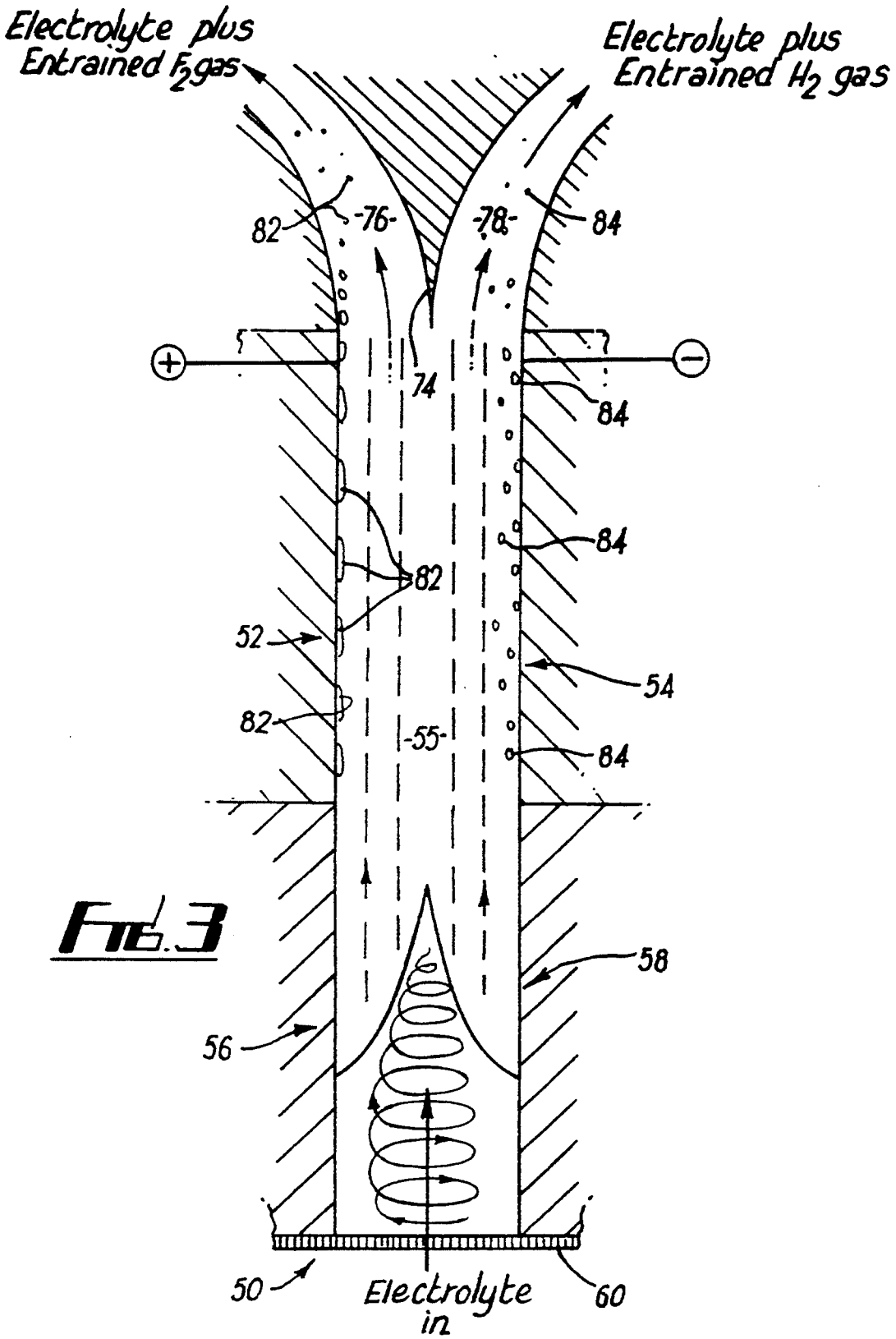
FIG. 3 shows to an enlarged scale a sectional diagrammatic representation of part of the cell of FIG. 2.

The fluorine liberated is entrained as bubbles 82 (see FIG. 3) in that portion of the electrolyte flowing over the anodes 52, and into the ducts 76, whilst the hydrogen liberated is entrained as bubbles 84 in that portion of the electrolyte flowing over the cathodes 54 and into the ducts 78. The fluorine is disengaged at the section 16 by known methods whilst hydrogen is disengaged by known methods in the section 18. Electrolyte residues from the sections 16, 18 flow to the filter unit 32 for the removal of abrasive solids (e.g. carbon particles) which would otherwise cause erosion of the system. The electrolyte filtrate from the filter unit 32 passes to the cooler 36 to maintain the temperature of the electrolyte at about 100° C. At the dosing tank 38, the electrolyte is replenished with HF (e.g. from storage vessels) to maintain the concentration of HF in the electrolyte at about 45 v/o, the electrolyte then being circulated by the pump 44 into the cell unit 10.

The fluorine and hydrogen entrained in the electrolyte may each comprise about 10 v/o, and when liberated at the sections 16, 18 may contain some HF—possibly between 15–20 v/o. This HF can be removed to a considerable extent (e.g. to less than 2 v/o) by known cryogenic techniques.

The anode 52 and cathode 54 have an optimum spacing apart of about 20 mm or less, e.g. 15 mm. Additional flow inducers, for example adjacent parallel plates may be disposed in the cell unit 10 to constrain the non-turbulent flow conditions, for example between the portions 56, 58. The non-turbulent flow required may allow a flow rate of up to about 0.8 m/sec of the electrolyte in the space 55, but 0.2 m/sec is the optimum flow rate. It is desirable that the non-turbulent flow of the electrolyte commences between the portions 56 and 58 before it reaches the anode 52 and the cathode 54. The direction of the flow of the electrolyte is designed to assist the removal of the fluorine and hydrogen from the space 55.

The non-turbulent flow of the electrolyte allows a more narrow gap to be used between the anode and the cathode for a given level of product recombination than in current designs where turbulent flow patterns require a larger gap. The non-turbulent flow may be streamline flow or laminar flow, preferably below Reynold's Number 2000, for example 500. The cell unit 10 may be operated at a selected pressure to reduce the volume occupied by the fluorine and the hydrogen, for example at a pressure of about 15 psig or higher (e.g. 400 psi) as an alternative to a pressure of a few inches wg or some intermediate pressure.

One advantage of the invention is that seals should not be necessary between adjacent cells 50 in the cell unit 10. The anode 52 and the cathode 54 may be located in slots in the vessel 46 to maintain control of the gap between opposing anodes 52 and cathodes 54.

If desired, the flow dividers 74 may be positioned so as to divide the electrolyte into unequal streams, preferably with the stream adjacent to the cathode being the larger stream.

The use of a flow of the electrolyte at a controlled temperature should reduce any tendency for "hot-spots" at the anode and "cold-spots" at the cathode usually found in conventional fluorine tank cells.

Although the invention has been described in relation to the use of steel as the cathode material other suitable materials may be used such as nickel or a nickel-based alloy (Monel).

Figure 4:
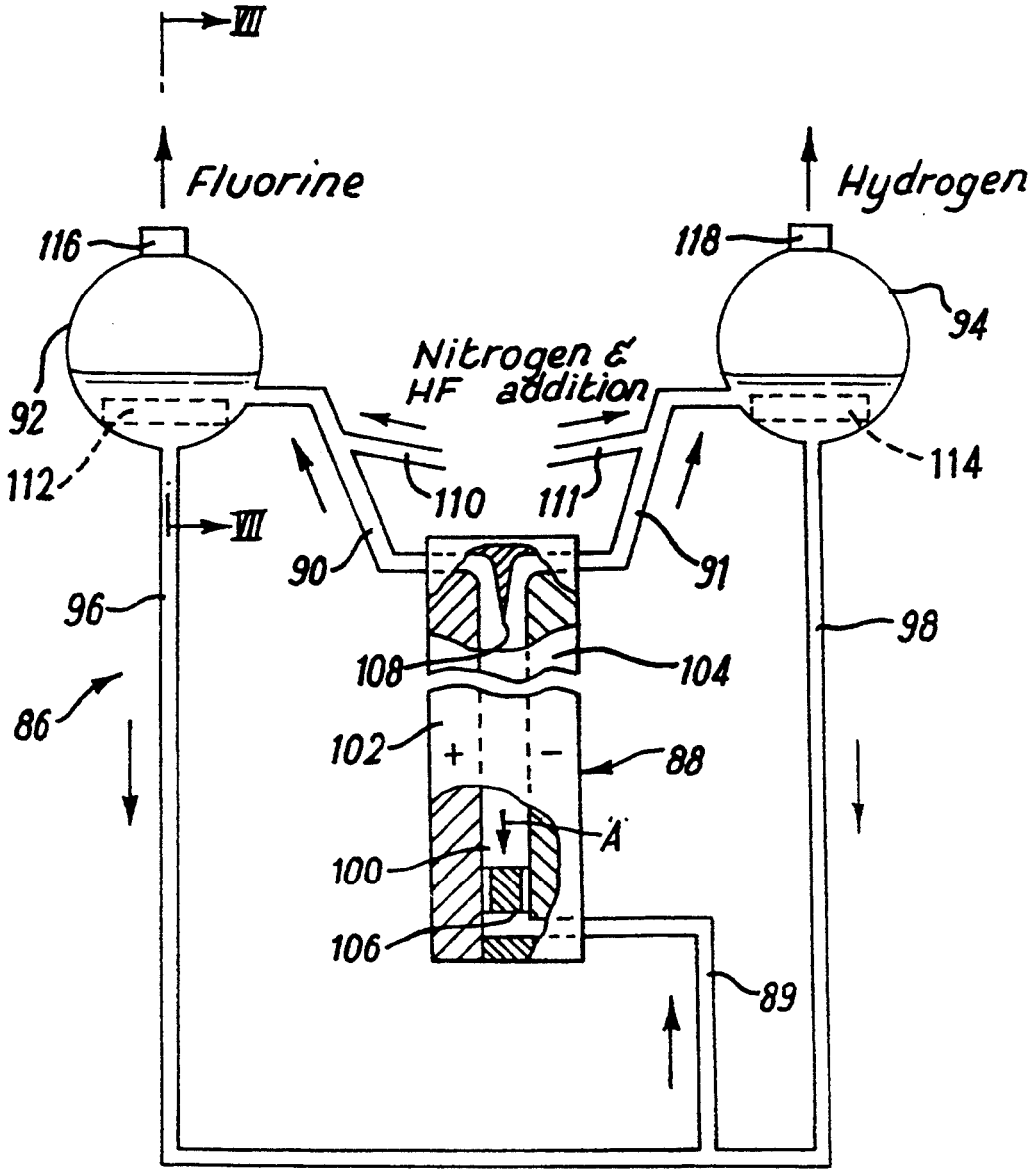
FIG. 4 shows an alternative fluorine production system.
Figure 5:
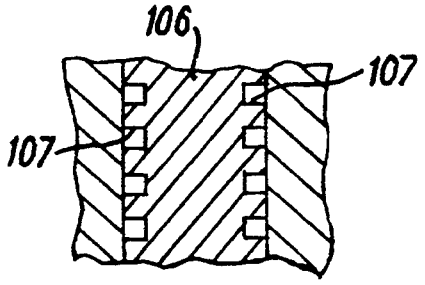
FIG. 5 shows a fragmentary view to an enlarged scale in the direction of arrow 'A' of FIG. 4.

A preferred system incorporating an electrolytic cell of the invention is shown in FIG. 4 to which reference is now made. In FIG. 4, the system 86 shown comprises an electrolytic cell 88 having an inlet duct 89 for electrolyte and outlet ducts 90, 91. The outlet duct 90 emerges from the anode region of the cell 88 and is joined to the lower portion of a disengagement vessel 92. The outlet duct 91 emerges from the cathode region of the cell 88 and is joined to the lower portion of a disengagement vessel 94. A return duct 96 connects the vessel 92 to the inlet duct 89, and a return duct 98 connects the vessel 94 to the inlet duct 89. The cell 88 is similar in many respects to the individual cells 50 of FIG. 2 in having a space 100 between a flat anode 102 and a flat cathode 104. A flow-straightener 106 at the base of the space 100 constrains electrolyte to flow in non-turbulent flow through the space 100. The flow-straightener 106, as shown in FIG. 5, defines a large number of evenly spaced channels 107 (e.g. about 3 mm square) for flow of the electrolyte therethrough. A knife-edged flow divider 108 at the top of the space 100 diverts the electrolyte flowing in the space 100 into the outlet ducts 90, 91 respectively. Branch ducts 110, 111 connect with respective outlet ducts 90, 91. A carbon filter 112, 114 respectively is disposed near the base of each vessel 92, 94, and a gas outlet 116, 118 respectively is provided at the top of each vessel 92, 94.

In operation with fused electrolyte containing potassium fluoride hydrogen fluoride (KF.2HF) at an operating potential of between 5.5 and 6.0 volts, the cell 88 operates in a similar manner to the cells 50 of FIG. 2. Electrolyte flows from the inlet duct 89 through the channels 107 of the flow-straightener 106 into the space 100 where it is subsequentener divided by the flow divider 108 to flow into the outlet ducts 90, 91 and the respective vessel 92, 94. The electrolyte occupies about one third of the height of each vessel 92, 94, fluorine being evolved in the vessel 92 and discharged through the outlet 116, and hydrogen being evolved in the vessel 94 and discharged through the outlet 118. After passing through the carbon filters 112, 114 to remove electrolyte residues and other solids, the electrolyte flows into the respective return ducts 96, 98 to rejoin the inlet duct 89. Addition of nitrogen and HF can be made through the branch ducts 110, 111 as necessary. The evolution of bubbles of fluorine and hydrogen in the space 100 provides an "air-lift pump" effect on the electrolyte in the space 100 such that the system 86 should operate without the constant need for a pump to circulate the electrolyte.

Figure 6:
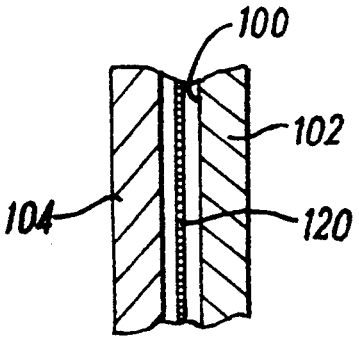
FIG. 6 shows a fragmentary view of a modified part of the system of FIG. 4.

In order to enhance the separation of the fluorine and hydrogen in the space 55 or 100, a porous gas separator 120 (shown enlarged for clarity in FIG. 6) may be placed between the respective anode and cathode for part or all of the length of the space 55 or 100. An example of a suitable separator is porous polyvinylidene fluoride (PVDF) having a pore size of about 100 microns.

The preferred form of electrolytic cell of the invention may be incorporated in a suitable plate and frame design.

Figure 7:
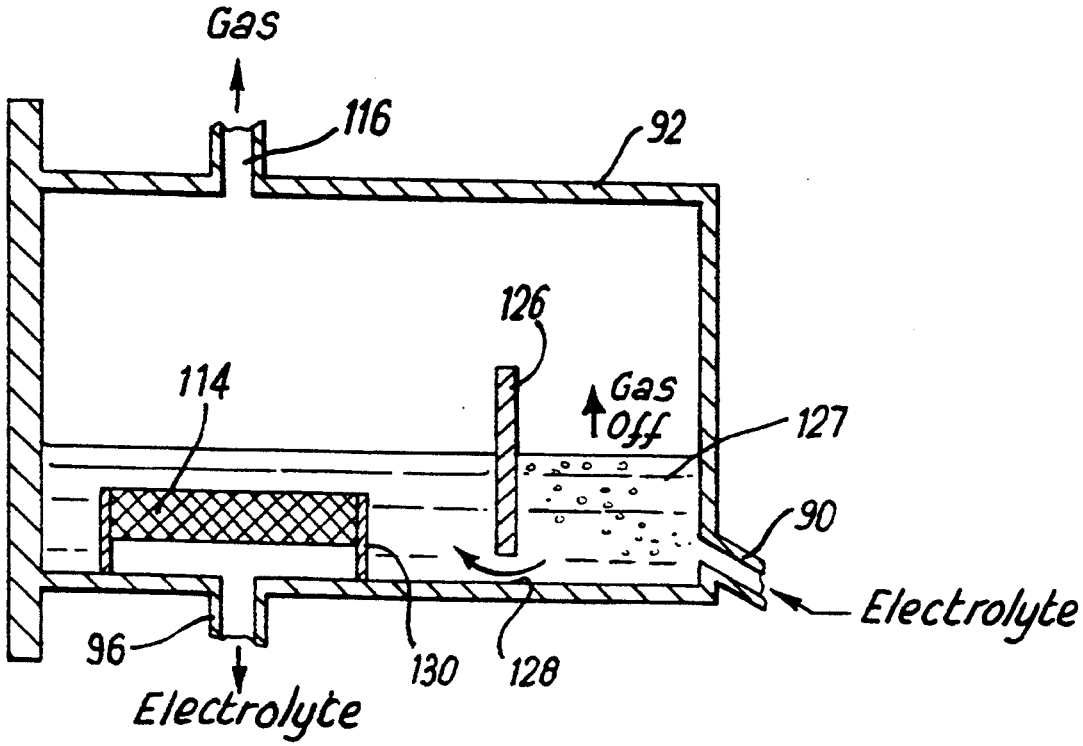
FIG. 7 shows a representation to an enlarged scale on the line VII—VII of FIG. 4.

An example of a suitable disengagement vessel 92 is shown in FIG. 7. The vessel 92 is cylindrical in longitudinal form, and has a weir plate 126 defining a gas bubbling space 127 and a bottom gap 128 through which electrolyte can pass to the carbon filter 114 held in a stub housing 130. Fluorine bubbling from the electrolyte flows towards the outlet 116. The size of the vessel 92 and the position of the weir plate 126 are selected so that electrolyte occupies about one third of the height of the vessel 92 which with the location of the gas bubbling space 127 minimizes the risk of particles of electrolyte being carried towards the outlet 116. The vessel 94 may be of similar form.

It will be apparent that the blockages caused by the effect of electrolyte "misting" in present cell designs may be overcome in the invention by disengaging the gas from the electrolyte in remote vessels 92, 94. The design of these vessels 92, 94 is free from the constraints of the space available between successive anode-cathode pairs. Thus, they may be designed sufficiently large, using standard chemical engineering principles, so that the gas velocities can be low enough not to entrain particles of electrolyte.

The design of the system 86 can be such that the inherently safe maximum off-gas pressure is that provided by the hydrostatic head between the base of the disengagement vessels 92, 94 and the lower point of the flow divider 108. This is the maximum operating pressure for which the reservoirs of fluorine and hydrogen will be kept apart in the event of a catastrophic failure of either a hydrogen or fluorine gas line. Since the disengagement vessels 92, 94 can be mounted serveral meters above the cell 88, this pressure equates to 5000 cm water gauge or more, compared with 5–10 cm for present cell designs.

Although the invention has been described in relation to the systems of FIGS. 1 and 4, it will be understood that the invention may be incorporated in alternative systems. Other forms of the apparatus, and of electrolytic cells for performing the process of the invention may be used, and appropriate heating means and cooling means may be incorporated in the systems of the invention.

I claim:

1. A process for the production of fluorine, the process comprising the steps of:

passing a single stream of a fluorine-containing electrolyte in non-turbulent flow between an anode and a cathode of an electrolytic cell without a separator extending the length of the cell between the anode and cathode, dividing the single stream of electrolyte emerging from between the anode and the cathode into two streams, one of said streams emerging adjacent to the anode having fluorine entrained therein, and the other of said streams emerging adjacent to the cathode having hydrogen entrained therein, and subsequently separating the fluorine and the hydrogen from the respective said streams.

2. An electrolytic cell for use in the process for the production of fluorine as claimed in claim 1, the cell comprising an anode and a cathode in relatively close juxtaposition, means for inducing a single stream of electrolyte to pass in non-turbulent flow between the anode and the cathode, and means for dividing the single stream of electrolyte emerging from between the anode and the cathode into two streams, one said streams emerging adjacent to the anode and the other said streams emerging adjacent to the cathode.

3. An electrolytic cell as claimed in claim 2 and wherein the anode and cathode have substantially flat surfaces in parallel opposing relationship, said substantially flat surfaces defining a gap of 20 mm or less.

4. An electrolytic cell as claimed in claim 2 and wherein the inducing means comprises at least one of a foraminuous element, baffles, a plurality of channels, and parallel plates, located at an entry to the space between the anode and the cathode.

5. An electrolytic cell as claimed in claim 2 and wherein the dividing means comprises a flow divider located substantially midway between the anode and the cathode.

6. An electrolytic cell as claimed in claim 5 and wherein the flow divider is located in offset relationship between the anode and the cathode.

7. An electrolytic cell as claimed in claim 6 and wherein the flow divider is off-set towards the anode to increase the volume of the stream containing the hydrogen.

8. An electrolytic cell as claimed in claim 2 and wherein the cell is incorporated in a system which includes separate vessels to provide disengagement of the fluorine and the hydrogen from their respective streams.

9. An electrolytic cell as claimed in claim 8 and wherein the cell includes an inlet at which two recombined streams of gas-free electrolyte from the disengagement vessels are re-admitted to the cell.

10. An electrolytic cell as claimed in claim 2 and wherein a permeable mesh gas separator is incorporated between the anode and the cathode for at least part of the length of the anode and the cathode.

11. An electrolytic cell as claimed in claim 10 and wherein the permeable mesh gas separator is porous polyvinylidene-fluoride (PVDF) having a pore size of about 100 microns.

12. A process as claimed in claim 1 and wherein the non-turbulent flow is streamline flow or laminar flow and the flow is at a Reynold's Number of less than 2000.

13. A process as claimed in claim 1 and wherein the flow is at a Reynold's Number of between 400 and 600.

14. A process as claimed in claim 12 and wherein the flow conditions are selected to constrain the fluorine and hydrogen produced to flow substantially adjacent to the anode and the cathode, respectively.

15. A process as claimed in claim 12 and wherein the non-turbulent flow is at a rate of up to about 0.8 m/s of the electrolyte between the electrodes.

16. A process as claimed in claim 12 and wherein the non-turbulent flow of electrolyte commences before it reaches the anode and the cathode.

17. A process as claimed in claim 1 and wherein the cell is operated at a pressure to reduce the volume occupied by the fluorine and the hydrogen.

* * * * *